US008747613B2

(12) United States Patent
Theiler et al.

(10) Patent No.: US 8,747,613 B2
(45) Date of Patent: Jun. 10, 2014

(54) PRESSURE DIFFUSER WITH LESS POWER RATING IN HYDRAULIC SYSTEM

(75) Inventors: Robert Theiler, Karlstad (SE); Allan Jonsson, Kil (SE)

(73) Assignee: Valmet AB, Sundsvall (SE)

( * ) Notice: Subject to any disclaimer, the term of this patent is extended or adjusted under 35 U.S.C. 154(b) by 118 days.

(21) Appl. No.: 13/392,100

(22) PCT Filed: Aug. 25, 2009

(86) PCT No.: PCT/SE2009/000390

§ 371 (c)(1),
(2), (4) Date: May 22, 2012

(87) PCT Pub. No.: WO2011/025412

PCT Pub. Date: Mar. 3, 2011

(65) Prior Publication Data

US 2012/0216977 A1 Aug. 30, 2012

(51) Int. Cl.
*D21C 9/04* (2006.01)

(52) U.S. Cl.
USPC ..... 162/60

(58) Field of Classification Search
CPC ..... D21C 9/04; D21C 9/007; D21C 9/02; D21C 9/06; D21C 9/18; D21C 9/00; D21C 7/00; D21D 1/40; D21D 5/00; D21D 5/20; B01D 33/60
USPC ..... 162/60, 251, 232, 233, 246; 8/156; 68/181 R; 210/331, 332, 333.01, 333.1, 210/334
See application file for complete search history.

(56) References Cited

U.S. PATENT DOCUMENTS

| | | | | |
|---|---|---|---|---|
| 4,276,167 | A * | 6/1981 | Richter et al. | 210/331 |
| 4,396,509 | A | 8/1983 | Foyn | |
| 4,556,494 | A | 12/1985 | Richter | |
| 4,908,896 | A | 3/1990 | Jacobson | |
| 5,129,119 | A * | 7/1992 | Sherman | 8/156 |

OTHER PUBLICATIONS

Paper Making Science and Technology, Book 6A—Chemical Pulping, Chapter 7, (1999).

* cited by examiner

*Primary Examiner* — Eric Hug
(74) *Attorney, Agent, or Firm* — Rolf Fasth; Fasth Law Offices

(57) ABSTRACT

The pressure diffuser incorporates a screen that has a considerable weight that is moved by a connecting rod in a reciprocating manner between an upper and lower position. The connecting rod is maneuvered by a hydraulic cylinder for vertically moving the screen in a first slow stroke concurrent with pulp-flow and moving the screen in a second fast stroke countercurrent to pulp-flow. The pressure diffuser has an inlet defined therein at the bottom of the vessel but the hydraulic cylinder is located at the top of the vessel. This design enables an increased active pressure area in the hydraulic cylinder for the fast stroke of the screen. This reduces the power-rating needed for the hydraulic system.

5 Claims, 3 Drawing Sheets

PRESSURE DIFFUSER WITH LESS POWER RATING IN HYDRAULIC SYSTEM

PRIOR APPLICATION

This application is a U.S. national phase application that is based on and claims priority from International Application No. PCT/SE2009/000390, filed 25 Aug. 2009.

FIELD OF THE INVENTION

The present invention relates to paper pulp treatment operations and particularly to a pressure diffuser for washing pulp wherein a screen basket is moved by a hydraulic system in a slow stroke at pulp speed and reversed in a fast stroke back to initial position. The typical pressure diffuser was designed by Kamyr AB, now known as Metso Fiber Karlstad AB, and was shown already in U.S. Pat. No. 4,944,167.

BACKGROUND OF THE INVENTION

Generally, a pressure diffuser useful in the paper pulp industry comprises an elongated generally vertically upstanding vessel which mounts an elongated annular screen for vertical movement within the vessel. Pulp under pressure flows into one end of the vessel and into the annular space between the screen and the exterior vessel wall and through an outlet adjacent the other end of the vessel. As the pressurized pulp traverses the height of the vessel, displacement liquid is introduced into the annular chamber by a plurality of vertically spaced header assemblies. The displacement liquid flows generally radially inwardly through the pulp, treating the pulp, and through the screen into the interior of the vessel furnished with a liquid outlet. The screen is moved in a slow stroke concurrently with the pulp a limited distance of travel and is then returned quickly in a fast stroke to clean the screen by a combined wiping and back flushing action. The different diameters of the upper and lower ends of the screen create filtrate compression and thus back flushing (e.g. see U.S. Pat. No. 4,396,509), during screen movement thus forcing the liquid through the screen holes to back flush the screen.

While such pressure diffusers have been used successfully, a drawback of this type of hydraulic system for moving the screen basket is the extensive load on the hydraulic system. The pressure diffusers have been delivered in different sizes from 1980 and a total of more than 100 units have been installed world wide. Pressure diffusers having a moderate size, i.e. pressure diffuser type TD70 with a washing capacity of above 1000 ADMT/24 h, have a total screen basket weight of about 16 ton, and most recent pressure diffusers for pulp mills of higher production capacity, for example pressure diffuser type TD140 with a washing capacity of above 2000 ADMT/24 h, have a total screen basket weight of about 40 ton. On top of these weights of the screen basket, must also the captured wash filtrate volume be managed, which for these sizes TD70/TD140 amounts to about 4,6 ton and 8,1 ton respectively. The typical design pressure for the hydraulic system for a pressure diffuser type TD70 is between 150 and 250 bar. The installed power rating and energy consumption is thus rather high.

SUMMARY OF THE INVENTION

According to the present invention, the above-identified drawback is overcome by locating the pulp inlet in the bottom of the vessel, and the hydraulic cylinder with a movable piston inside the hydraulic cylinder is located at the top of the vessel.

By this design could an increased active pressure area in the hydraulic cylinder be obtained for the fast stroke of the screen, thus restricting the power rating of the hydraulic system, as the peak power requirements are developed during the fast stroke of the screen.

According to a further detailed aspect is also the movable piston inside the hydraulic cylinder connected to the screen via the connecting rod such that a ring shaped hydraulic chamber, penetrated by said connecting rod, is located below the piston of the hydraulic cylinder. Hence, preferably is also a full size hydraulic chamber not penetrated by any connecting rod located above the piston of the hydraulic cylinder.

Accordingly, it is a primary object of the present invention to provide novel and improved apparatus for washing pulp in a pressure diffuser in a manner to reduce the necessary installed power rating, and reduce the energy consumption for continuous operation. Yet another objective is to be able to reduce the top pressures needed for the hydraulic unit, which will decrease wear on components as well as decrease the installation costs for a hydraulic unit with lower capacity but still able to perform the intended functions.

These and further objects and advantages of the present invention will become more apparent upon reference to the following specification, drawings and claims.

DETAILED DESCRIPTION OF THE DRAWINGS

Figure 1:
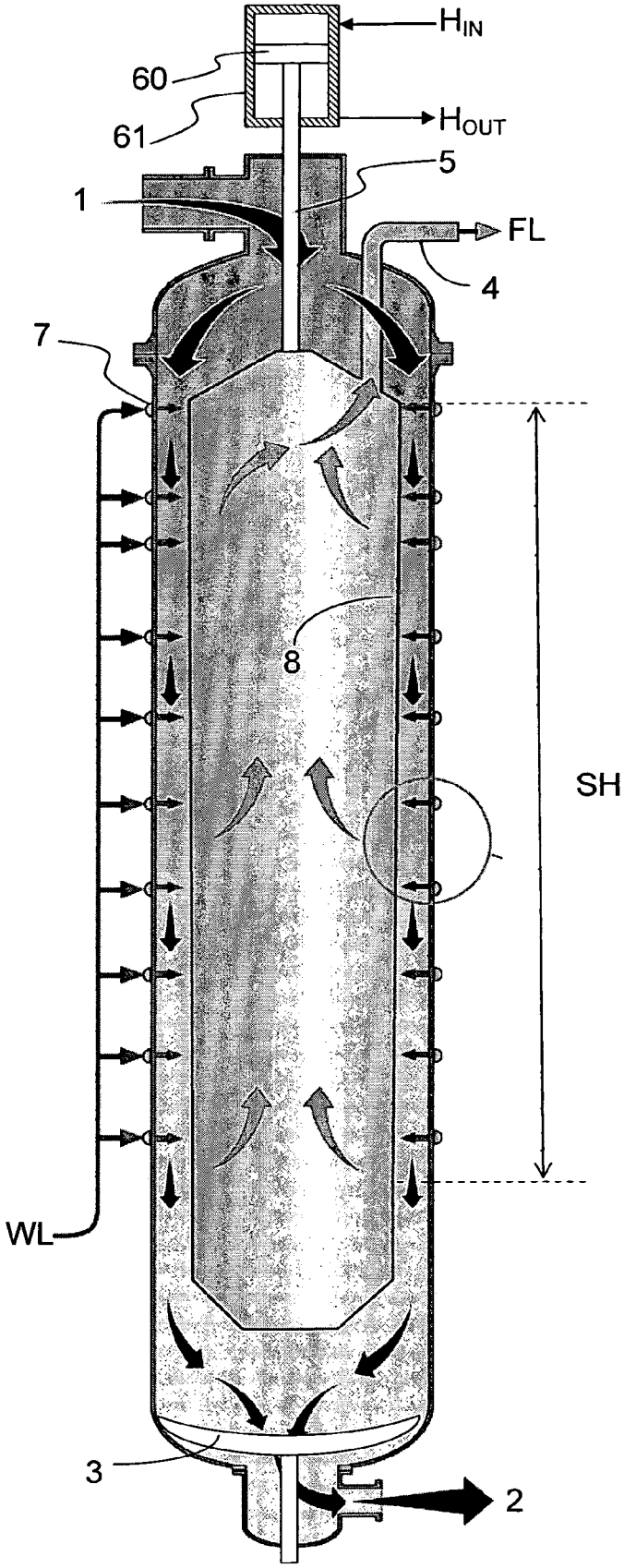
Prior art Fig.1
FIG. 1 is a vertical cross-sectional view through the center line of a pressure diffuser according to a prior art design, i.e. the design presently sold by Metso and originally developed by Kamyr AB.
Figure 2:
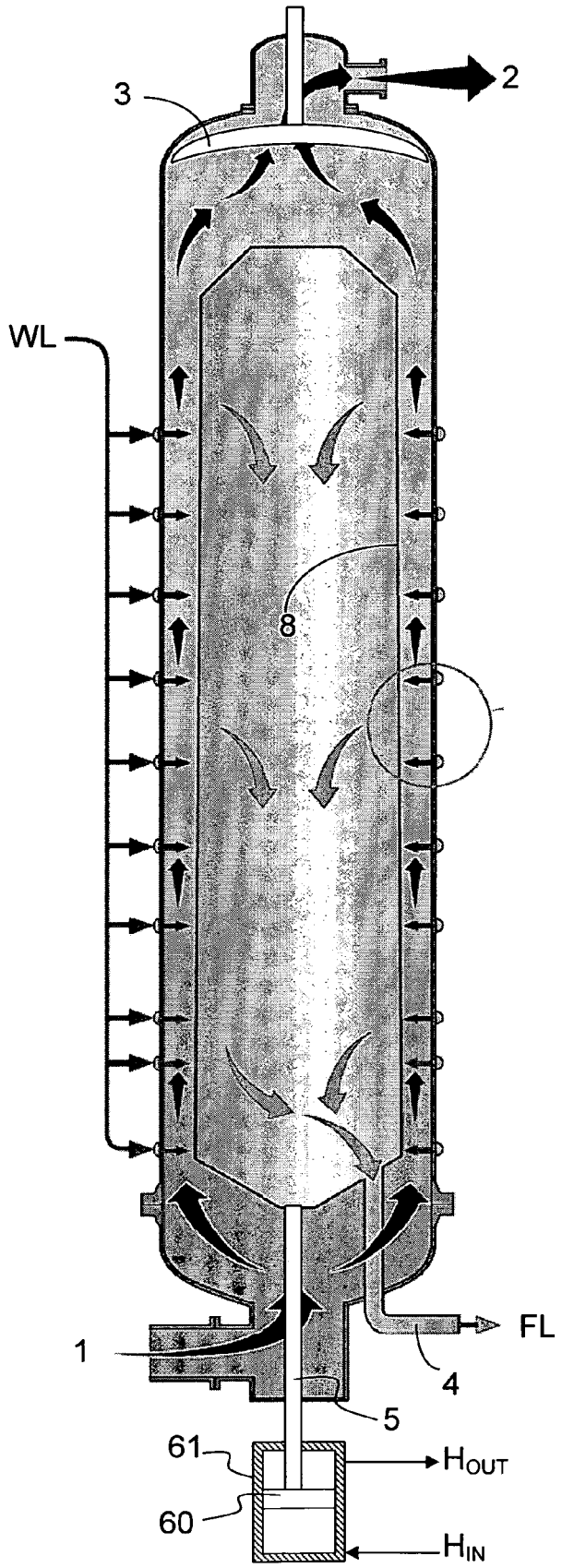
Prior art Fig.2
FIG. 2 is a vertical cross-sectional view through the center line of a pressure diffuser according to another prior art design, i.e. the design presently sold by Andritz INC and originally developed by Kamyr INC.

Reference will now be made in detail to the present preferred embodiment of the invention, an example of which is illustrated in the accompanying drawing FIG. 3. In the prior art embodiments shown in FIGS. 1 and 2 are pressure diffuser shown with a pulp flow (dark-grey flow arrows in figures) direction moving from top to bottom in FIG. 1 or with reversed flow direction as depicted in FIG. 2. In the prior art embodiment shown in FIG. 1 is a pressure diffuser shown with the hydraulic unit arranged at the top, which lifts the screen unit slowly upwardly against the gravity and in parallel with the flow direction of pulp. In the prior art embodiment shown in FIG. 2 is a pressure diffuser shown with the hydraulic unit arranged at the bottom, which push the screen unit 8 slowly upwardly against the gravity and in parallel with the flow direction of pulp. A disadvantage in this design is that the entire screen unit 8 is supported and balanced at the lower end, which will cause excessive wear in guides (not shown here) arranged in the upper part for the screen unit. Typically is also a discharge scraper 3 located at the opposite end of the diffuser, which purpose is to assist in out feed of washed pulp. Thus, the hydraulic cylinder is conventionally located in the opposite end to the out feed end and associated discharge scraper. According to both these prior art designs are the fast return stroke activated by pressurizing the ring-shaped cylinder surrounding the connecting rod 5, and hence is a lower net active piston area possible for the fast stroke.

Referring now to common features of all drawing figures, there are illustrated pressure diffusers comprised of a generally vertically upstanding pressure vessel. The vessel is closed except for a pulp inlet 1 adjacent a top or bottom portion of the vessel and a pulp outlet 2 adjacent the opposite end portion of the vessel. Typically is also discharge scrapers 3 arranged near the outlet. The elongated annular screen unit 8 is generally slightly conical in shape and tapers radially inwardly in the pulp feed direction. Thus, as illustrated in FIG. 1, pulp enters the vessel through the pulp inlet 1 and passes downwardly through an annular interior volume defined between the inwardly facing pressure vessel wall and the outwardly facing surface of the screen 8 for flow out of the vessel through pulp outlet 2. A plurality of headers 7, here 10 headers shown, each having an inlet are disposed about the exterior of the vessel wall for adding displacement liquid, i.e. wash liquid WL, in a radial directions trough the pulp bed caught between the inside of the pressure vessel wall and the screen unit surface (light-grey flow arrows in figures). Thus, liquid is introduced by said headers at vertically spaced positions trough the pressure vessel wall by nozzle bores in said wall located substantially circumferentially about the interior volume at each vertical location. The screen unit 8 is reciprocal in a generally vertical axial direction, preferably by means of a hydraulic cylinder 61 The piston 60 of the hydraulic cylinder 61 is connected to the screen unit 8 via a connecting rod 5 that displaces the screen unit 8 in a vertically upward or downward direction as desired. It will be appreciated that in normal operation, the screen conventionally moves in the direction of the flow of pulp and then is rapidly moved against the flow of pulp in order to obtain both back flushing of the screen and reversal to a new start position for a washing stroke. The total screen height in the screen unit is indicated with reference sign SH. In operation, it will be appreciated that pulp is provided through inlet 1 and into the annular chamber between the pressure vessel wall and screen unit 8 and flows outwardly from the vessel through outlet 2. Displacement liquid WL is introduced through the headers 7 and passes generally radially inwardly through the pulp and then through the outer screen surface of the screen unit 8 where displaced liquid is separated from the pulp and collected in the interior volume within the screen unit 9. Spent displacement liquid FL is removed from the interior volume by an outlet conduit 4. Generally, the screen unit 8 is pushed during the wash displacement stroke in the direction of pulp flow, and at a similar speed as the flow of pulp. This is accomplished by the hydraulic cylinder 61 pushing the connection rod 5 into pressure vessel to displace the screen unit 8 concurrent with the pulp flow direction.

Figure 3:
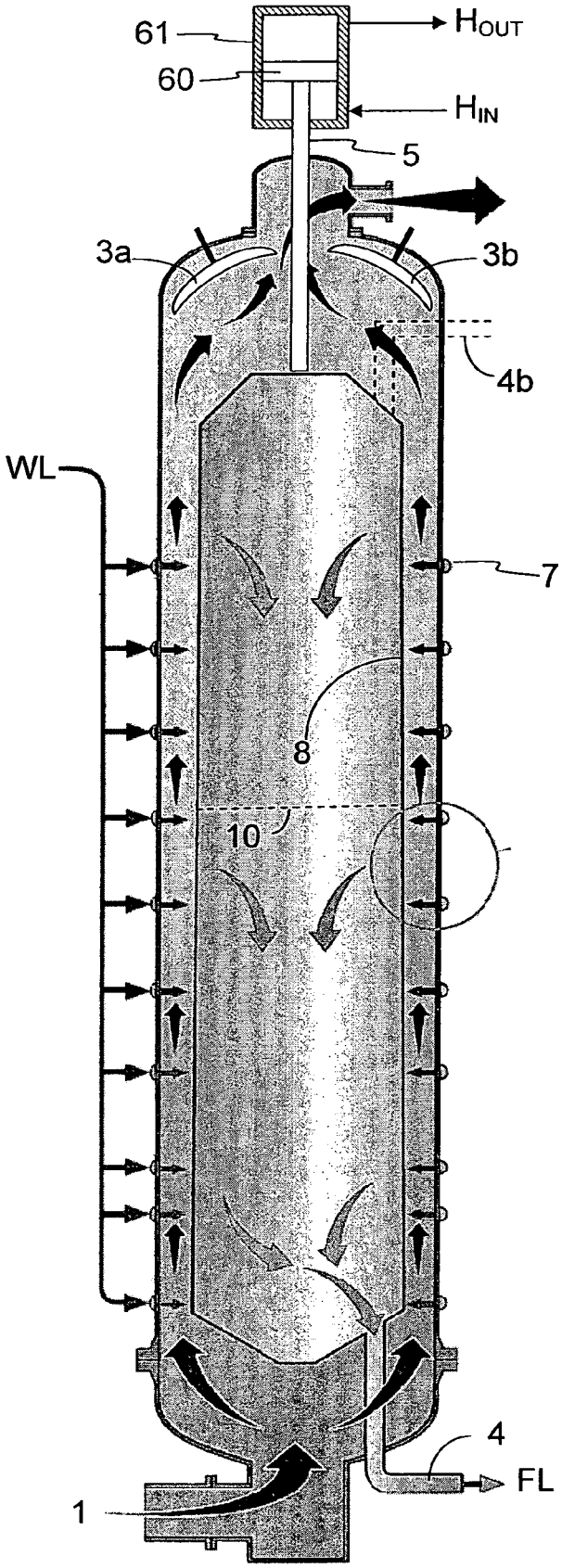
FIG. 3 is a vertical cross-sectional view through the center line of a pressure diffuser according to the invention used to control movement of the screen unit.

Referring now to the invention as shown in FIG. 3 is instead the the pulp inlet 1 is located in the bottom of the vessel, and the hydraulic cylinder 61 with a movable piston 60 inside the hydraulic cylinder is located at the top of the vessel. The movable piston 60 inside the hydraulic cylinder is connected to the screen 8 via the connecting rod 5, such that a ring shaped hydraulic chamber penetrated by said connecting rod 5 is located below the piston 60 of the hydraulic cylinder 61. Hence, a full size hydraulic chamber not penetrated by any connecting rod is located above the piston of the hydraulic cylinder. Instead of a single discharge scraper with a central drive shaft as shown in FIGS. 1 and 2 are instead several discharge scrapers 3*a*, 3*b* located with their drive shafts offset from the center line of the pressure diffuser. These discharge scrapers could be installed in numbers of 3 or preferably 4 units, and located at angular positions at 120 respectively 90 degrees apart in the circumferential direction. Thus, the hydraulic cylinder 61 and the discharge scraper could thus be arranged in the same end of the pressure diffuser. As indicated could also the interior of the screen unit 8 be equipped with at least one separating wall 10, indicated by a dashed line, which could separate the wash filtrate FL into 2 fractions or more, which second fraction could be evacuated by a second wash filtrate outlet 4*b*, indicated by dashed lines. By such an arrangement could a multi step washing function be obtained with physical separation of the filtrates. Such a physical wall may not be necessary in a pressure diffuser as shown in FIG. 1, as the hotter wash filtrate is collected in the upper part of the screen unit, while successively colder wash filtrates is collected in lower parts of the screen unit, and thus is no mixing of filtrates by heat convection induced, as the filtrates will be separated due to difference in temperature and specific weight.

Implementation

If the inventive concept is installed in a pressure diffuser of the type TD140 (having a washing capacity of 2000 ADMT pulp/24 h), then the main hydraulic cylinder 61 has a diameter of 380 mm, and the connecting rod in the hydraulic cylinder has a diameter of 180 mm. The net active force actuating area of the piston in the ring shaped chamber is then only some 879 $cm^2$, while the force actuating area of the piston in the full size chamber is 1133 $cm^2$. The force actuating area of the piston in the full size chamber is thus almost 28% larger than the one in the ring shaped chamber. This dramatically larger force actuating area for the fast stroke, which sets the ultimate requirements for the necessary peak pressure and capacity of hydraulic pumps, could instead be used to choose smaller standard pumps at more modest power ratings.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. For example, under the generic main claim could other discharge means than the discharge scrapers shown in FIG. 3 be used, i.e. using transversely mounted transport screws e.t.c. Parallel accumulator cylinders for further reduction of power consumption in the hydraulic system as shown in pending PCT SE2009/050367 could also be used as well.

The invention claimed is:

1. A pressure diffuser for washing pulp, comprising:

a generally upright, liquid-tight, pressurized vessel having a first interior volume defined therein for containing pulp to be treated under pressure;

the vessel having a pulp inlet defined therein;

the vessel having a pulp outlet defined therein, the vessel having only one elongate annular interior volume defined between an inwardly-facing pressure-vessel wall and an outwardly-facing surface of the screen body, the screen body standing up within the vessel in the first interior volume, the annular interior volume being conical-shaped;

the vessel having a generally vertical pulp-flow disposed between the pulp inlet and the pulp outlet through the annular interior volume;

the annular interior volume containing pulp and having upper and lower ends of different cross-sectional area, the pulp-flow being only flowable through the elongate annular interior volume;

the inwardly-facing pressure-vessel wall having a plurality of headers disposed therein, the headers being in fluid communication with a wash fluid source and having nozzle means for introducing a wash liquid radially inwardly through the pulp-flow flowing in the elongate annular interior volume and into the hollow screen body;

extraction means for withdrawing a liquid (FL) from the pulp-flow through the hollow screen body, a hydraulic cylinder, disposed above the vessel, having a connecting rod extending centrally through a top end of the vessel to the hollow screen body, the hydraulic cylinder having moving means for vertically moving the hollow screen body via the connecting rod in a first slow stroke concurrent with the pulp-flow and at a pulp-flow speed and moving the hollow screen body in a second fast stroke countercurrent to the pulp-flow;

the pulp inlet being located at a bottom of the vessel, the hydraulic cylinder, having a movable piston inside the hydraulic cylinder, being located at a top of the vessel, the movable piston being connected to the screen via the connecting rod, the connecting rod having a first end connected to the movable piston and a second opposite end connected to the screen, the hydraulic cylinder having a ring-shaped bottom hydraulic chamber defined therein penetrated by the connecting rod, the ring-shaped bottom hydraulic chamber being located below the movable piston; and the hydraulic cylinder having a top hydraulic chamber defined therein not penetrated by any connecting rod, the top hydraulic chamber being located above the movable piston.

2. The apparatus according to claim 1 wherein at least one discharge scraper is located at the top of the vessel.

3. The apparatus according to claim 1 wherein the connected rod extends between discharge scrapers located at the top of the vessel.

4. A pressure diffuser for washing pulp, comprising:

a generally upright, liquid-tight, pressurized vessel having a first interior volume defined therein for containing pulp to be treated under pressure;

the vessel having a pulp inlet defined therein;

the vessel having a pulp outlet defined therein, the vessel having only one elongate annular interior volume defined between an inwardly-facing pressure-vessel wall and an outwardly-facing surface of a hollow screen body, the screen body standing up within the vessel in the first interior volume, the annular interior volume being conical-shaped;

the vessel having a generally vertical pulp-flow disposed between the pulp inlet and the pulp outlet through the annular interior volume;

the annular interior volume containing pulp and having upper and lower ends of different cross-sectional area, the pulp-flow being only flowable through the elongate annular interior volume;

the inwardly-facing pressure-vessel wall having a plurality of headers disposed therein, the headers being in fluid communication with a wash fluid source and having nozzle means for introducing a wash liquid radially inwardly through the pulp-flow flowing in the elongate annular interior volume and into the hollow screen body;

extraction means for withdrawing a liquid (FL) from the pulp-flow through the hollow screen body, a hydraulic cylinder having moving means for vertically moving the hollow screen body via a connecting rod in a first slow stroke concurrent with the pulp-flow and at a pulp-flow speed and moving the hollow screen body in a second fast stroke countercurrent to the pulp-flow;

the pulp inlet being located at a bottom of the vessel, the hydraulic cylinder, having a movable piston inside the hydraulic cylinder, being located at a top of the vessel, the movable piston being connected to the screen via the connecting rod, the hydraulic cylinder having a ring-shaped bottom hydraulic chamber defined therein penetrated by the connecting rod, the ring-shaped bottom hydraulic chamber being located below the movable piston; and the hydraulic cylinder having a top hydraulic chamber defined therein not penetrated by any connecting rod, the top hydraulic chamber being located above the movable piston, at least one discharge scraper being located at the top of the vessel, the apparatus having at least three discharge scrapers, each discharge scraper having a drive shaft offset from a center line of the pressure diffuser.

5. The apparatus according to claim 4 wherein the discharge scrapers are located at even angular positions in a circumferential direction.

* * * * *